US007609226B1

(12) United States Patent
MacGahan et al.

(10) Patent No.: US 7,609,226 B1
(45) Date of Patent: Oct. 27, 2009

(54) ANTENNA SYSTEM WITH BASE CONFIGURATION FOR PASSIVE INTER-MODULATION (PIM) MITIGATION

(75) Inventors: Jonathan P. MacGahan, Ivyland, PA (US); R. Mark Clark, Langhorne, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 148 days.

(21) Appl. No.: 11/841,225

(22) Filed: Aug. 20, 2007

(51) Int. Cl.
*H01Q 1/36* (2006.01)

(52) U.S. Cl. ..... 343/895; 343/846

(58) Field of Classification Search ..... 343/713, 343/715, 846, 895
See application file for complete search history.

(56) References Cited

U.S. PATENT DOCUMENTS 2,644,089 A * 6/1953 Bliss ..... 343/723
4,184,160 A * 1/1980 Affronti ..... 343/712
4,931,806 A * 6/1990 Wunderlich ..... 343/715
5,367,311 A * 11/1994 Egashira et al. ..... 343/749
5,706,019 A * 1/1998 Darden et al. ..... 343/895

* cited by examiner

*Primary Examiner*—Tho G Phan
(74) *Attorney, Agent, or Firm*—McDermott Will & Emery LLP

(57) ABSTRACT

An antenna system comprises an antenna element, a base plate, and a ground plane. The antenna element is configured to radiate signals, receive signals, or radiate and receive signals. The base plate has a front surface facing the antenna element and a rear surface facing away from the antenna element. The front surface of the base plate has an uncovered area, and the uncovered area of the base plate has no exposed conductive mechanical joints. The ground plane has a front surface facing the antenna element and a rear surface facing away from the antenna element. The antenna system further comprises a capacitive coupling between the base plate and the ground plane formed by an overlap region between the base plate and ground plane. The ground plane is capacitively coupled to the base plate in the overlap region.

22 Claims, 10 Drawing Sheets

ANTENNA SYSTEM WITH BASE CONFIGURATION FOR PASSIVE INTER-MODULATION (PIM) MITIGATION

STATEMENT AS TO RIGHTS TO INVENTIONS MADE UNDER FEDERALLY SPONSORED RESEARCH OR DEVELOPMENT

Not Applicable.

FIELD OF THE INVENTION

The present invention generally relates to antenna systems and, in particular, relates to antenna systems having performance requirements for passive inter-modulation.

BACKGROUND OF THE INVENTION

Complex antenna systems are typically assembled from a combination of radiating elements, reflectors, and ground planes. Radiating elements are typically attached to reflectors or ground planes by bolting or similar mechanical methods wherein electrical coupling between components is achieved through conductor-to-conductor contact.

The inventors discovered the following: conductor-to-conductor contact is undesirable in applications in which passive inter-modulation (PIM) is of concern. Electrical coupling by conductor-to-conductor contact can produce PIM in antenna systems that transmit a plurality of signals. Radio frequency (RF) currents flow on the surfaces of reflectors and ground planes. PIM products arise because conductor-to-conductor contacts exhibit non-linear electrical behavior, arising, for example, from corrosion of the metal surfaces in the contact region.

SUMMARY OF THE INVENTION

This present invention provides a non-conductive method of interconnecting antenna components and, in particular, provides a method of interconnecting antenna components such as an antenna element and associated components for the purpose of mitigating inter-modulation (PIM).

According to one embodiment of the present invention, an antenna system comprises an antenna element, a base plate, and a ground plane. The antenna element is configured to radiate signals, receive signals, or radiate and receive signals. The base plate has a front surface facing the antenna element and a rear surface facing away from the antenna element. The front surface of the base plate has an uncovered area, and the uncovered area of the base plate has no exposed conductive mechanical joints. The ground plane has a front surface facing the antenna element and a rear surface facing away from the antenna element. The antenna system further comprises a capacitive coupling between the base plate and the ground plane formed by an overlap region between the base plate and ground plane. The ground plane is capacitively coupled to the base plate in the overlap region.

According to one embodiment of the present invention, an antenna system comprises an antenna element, a base plate, and a ground plane. The antenna element is configured to radiate signals, receive signals, or radiate and receive signals. The base plate has a front surface facing the antenna element and a rear surface facing away from the antenna element. The ground plane has a front surface facing the antenna element and a rear surface facing away from the antenna element. The antenna system further comprises a capacitive coupling between the base plate and the ground plane formed by an overlap region between the base plate and ground plane. The ground plane is capacitively coupled to the base plate in the overlap region. A capacitance created by the base plate and the ground plane within the overlap region is greater than a capacitance created by the base plate and the ground plane outside the overlap region. The antenna system further comprises mechanical joints mounted from a rear side of the antenna system. The mechanical joints are not viewable from a front side of the antenna system.

Additional features and advantages of the invention will be set forth in the description below, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention.

DETAILED DESCRIPTION OF THE INVENTION

Figure 1:
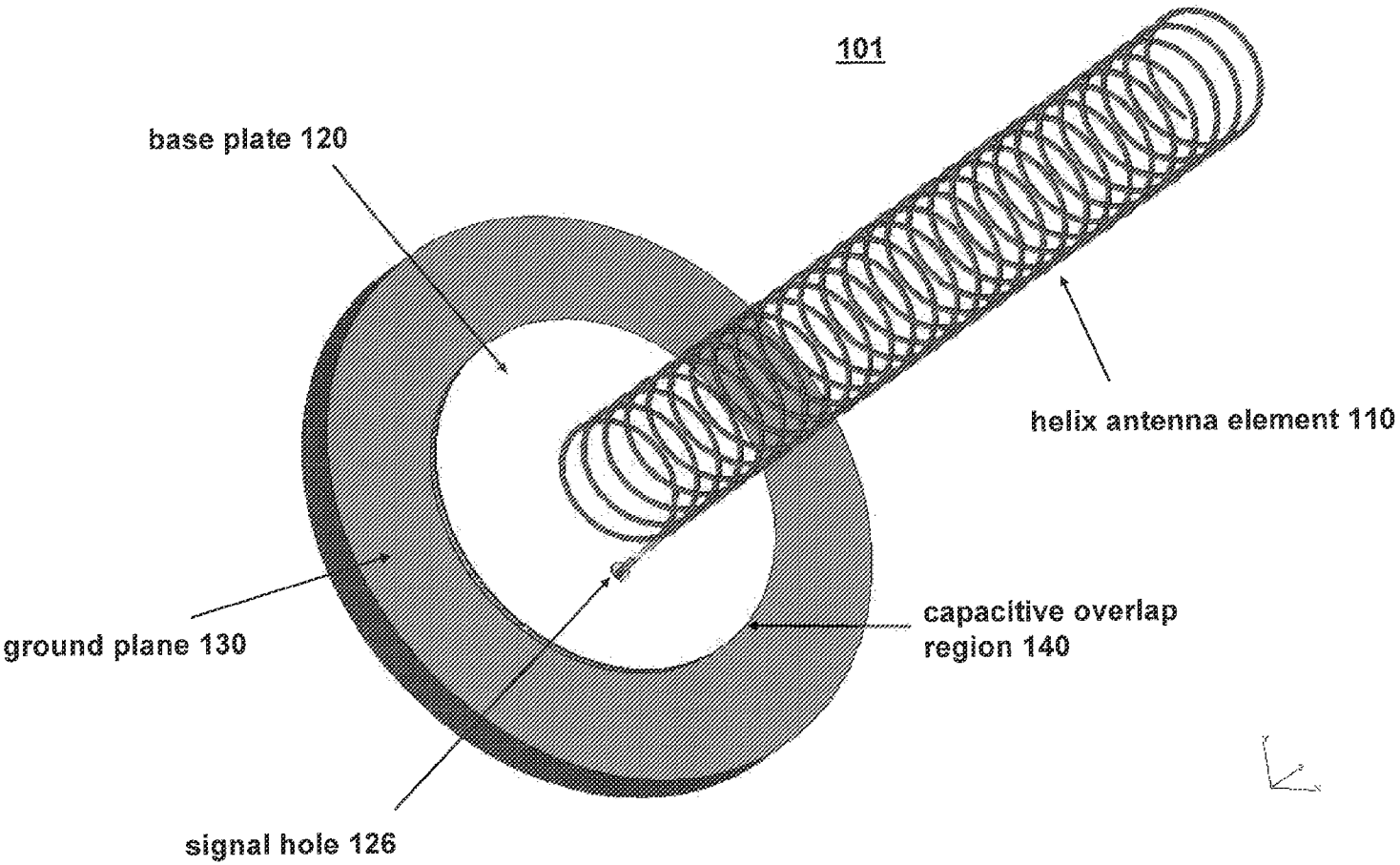
FIG. 1 is a simplified view of a helix antenna system seen from the front of the antenna system in accordance with one embodiment of the present invention.

In the following detailed description, numerous specific details are set forth to provide a full understanding of the present invention. It will be obvious, however, to one ordinarily skilled in the art that the present invention may be practiced without some of these specific details. In other instances, well-known structures and techniques have not been shown in detail so as not to obscure the present invention.

Methods for assembling antenna elements to ground planes and reflectors in passive inter-modulation (PIM) sensitive systems include welded, brazed, and soldered interconnections and special high-contact-pressure designs.

Hard couplings achieved through welding, brazing and soldering are impractical in applications that require disassembly and reassembly. Hard couplings may be unsuitable because antenna components cannot withstand these operations or are not accessible. Welding, brazing, and soldering to composite structures such as graphite fiber epoxy composite (GFEC) is not possible.

Achieving a required degree of PIM mitigation through use of high contact-pressure bolted connections is highly workmanship dependent, often unreliable, and often prohibitively difficult. The surface finish and flatness requirements at the mating surfaces are difficult to achieve and easily damaged. The required contact pressures are difficult to achieve over the temperature extremes encountered by satellite payloads.

According to various aspects, the present invention is more robust. Repeated assembly and disassembly of antenna components is possible without endangering PIM performance. Surface finish and flatness requirements are less demanding than for the high contact pressure method. The present invention is also suitable for use with composite materials. No high-temperature operations are required. Furthermore, potential PIM sources associated with conventional mechanical joints are eliminated or moved to the rear of the antenna ground plane where the radio frequency (RF) fields are greatly reduced, significantly mitigating the risk of PIM.

According to one aspect of the present invention, a non-conductive technique is provided for interconnecting antenna components, which can be used, for example, to advantage in PIM sensitive antenna systems. The non-conductive technique provides proper RF coupling among the components as required for antenna system function, but eliminates conductor-to-conductor contact and the associated PIM risk. RF coupling among the antenna components is achieved by capacitive coupling.

In accordance with various embodiments of the present invention, a novel configuration of the antenna components is provided at the rear of a capacitive overlap region. In this configuration, incidental capacitance among the coupled antenna components that lie rearward of the capacitive overlap region is minimized. This mitigates PIM that might otherwise arise from the RF currents flowing on the rearward structures. The RF current level at the rear of the structure is directly related to the incidental capacitance. Incidental capacitance among the rearward components is minimized by establishing, for example, large air gaps between components, avoiding large parallel surfaces.

A high capacitance area is utilized in conjunction with a low capacitance area according to various embodiments of the present invention. These two areas may also be envisioned as a low impedance transmission line (the high capacitance area) followed by a high impedance transmission line (the low capacitance area). The two areas form a rudimentary low-pass filter, attenuating the RF current level on the rearward structures.

The attached figures depict representative examples of the present invention. The base plates of a helical antenna system (see FIGS. 1-5) are attached to ground planes using an annular capacitive overlap region. Thin layers of non-conductive material such as Kapton® film between the surfaces prevent metal-to-metal contact and function as the capacitor dielectric.

According to one embodiment, the antenna components are attached together using non-conductive mechanical joints such as non-conductive fasteners (e.g., plastic screws), non-conductive clamping arrangements (e.g., plastic brackets), and/or non-conductive bonding (e.g., epoxy, room temperature vulcanizing (RTV) silicon rubber). A plastic gasket, air gap, or other non-conductive barrier prevents contact between the components. In an alternate embodiment, conductive mechanical joints such as conductive fasteners, conductive clamping arrangements and/or conductive bonding are utilized. In yet another embodiment, a combination of conductive and non-conductive mechanical joints can be utilized.

According to one aspect, the present invention allows the use of conventional metallic fasteners with a clamp arrangement to mount the antenna components on the rear of the ground plane. With this configuration, the mechanical joints, which are potential PIM sources, are all on the rear side of the ground plane. Because the RF current density is significantly reduced at the rear side of the ground plane, the PIM risk associated with the mechanical joints is greatly mitigated. This allows the use of conventional mechanical fasteners to produce a structurally robust joint without introducing significant PIM risk.

Figure 2:
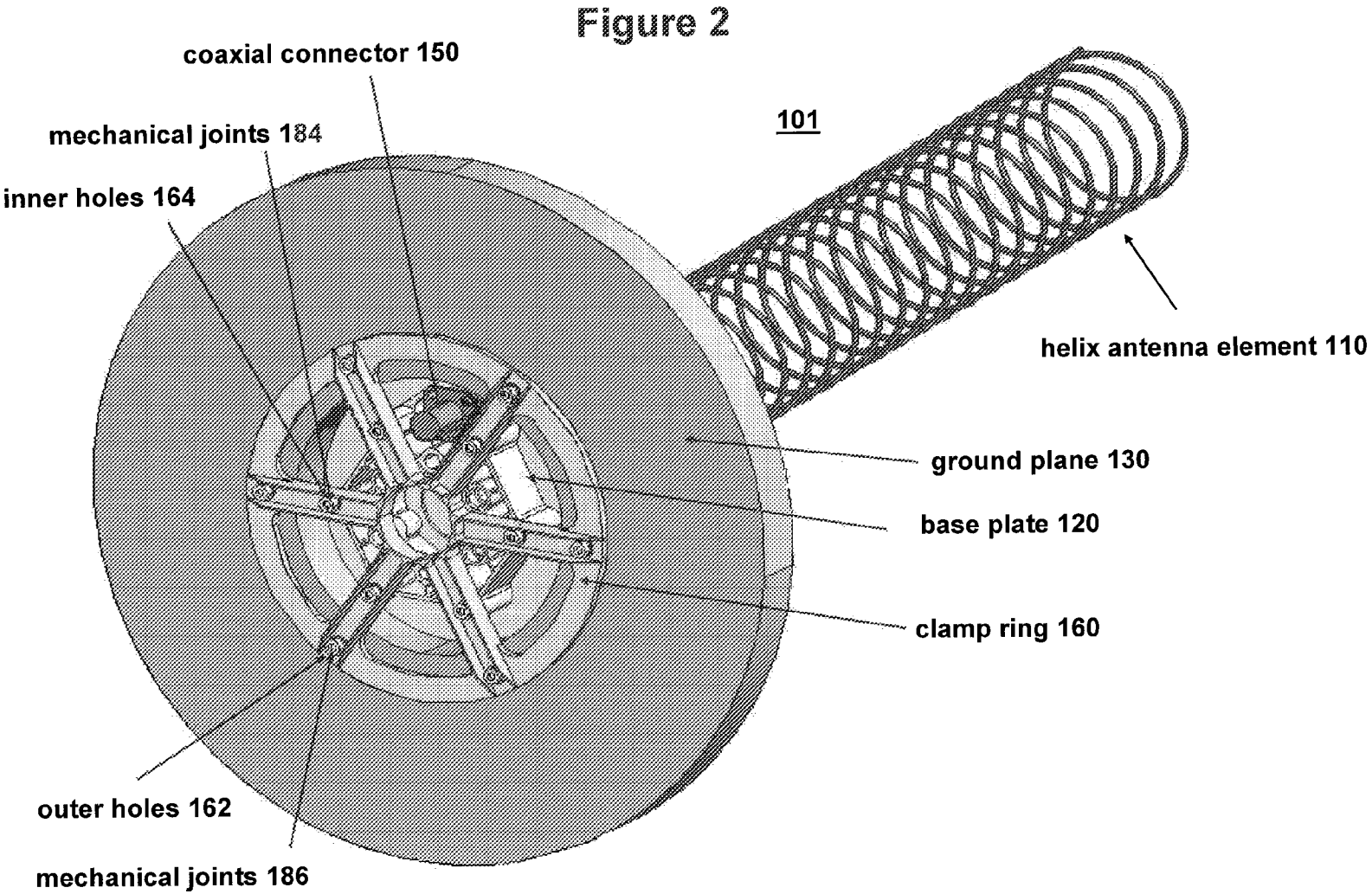
FIG. 2 is a simplified view of the helix antenna system seen from the back of the antenna system in accordance with one embodiment of the present invention.
Figure 3:
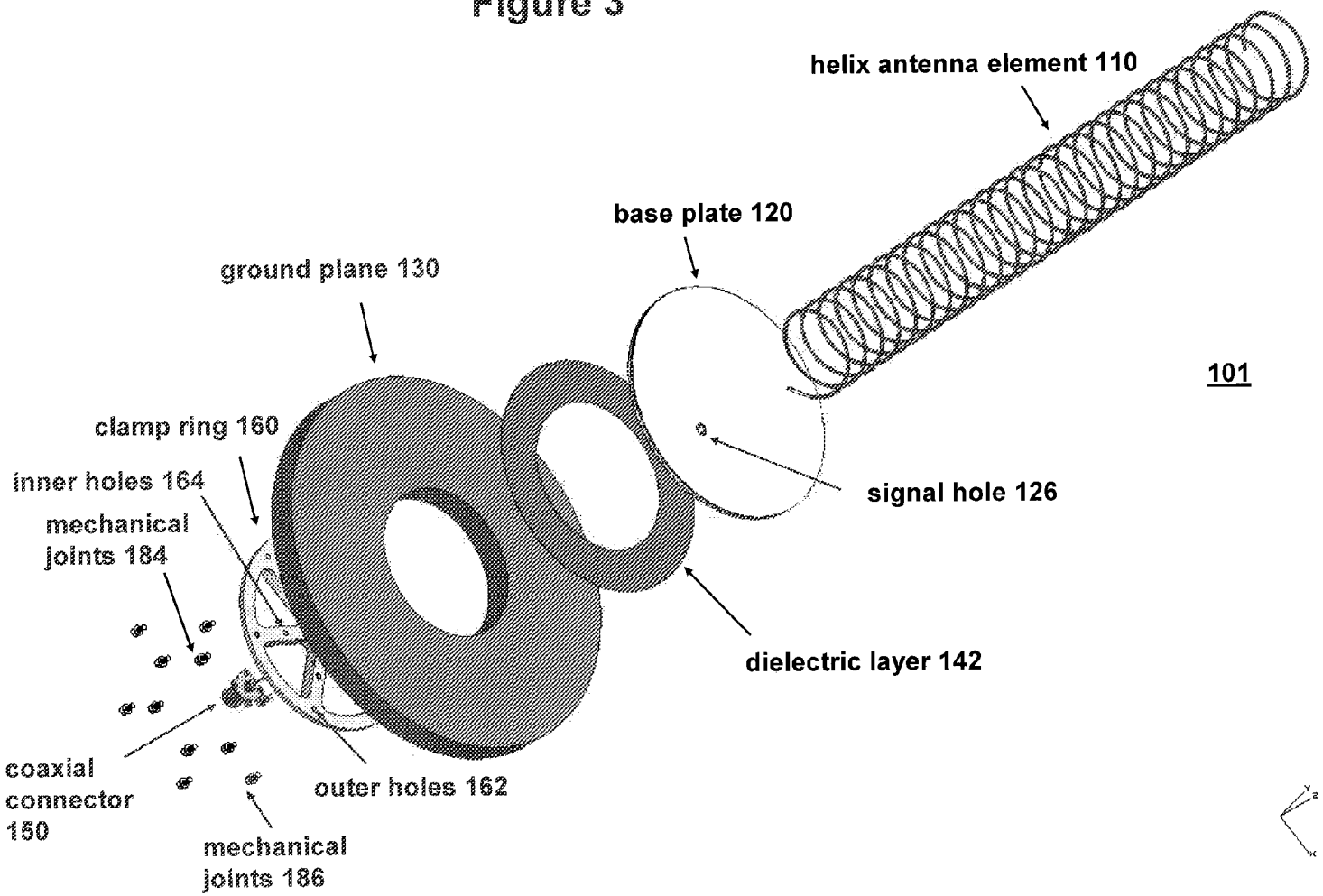
FIG. 3 is an exploded partial view of the helix antenna system seen from the front of the antenna system in accordance with one embodiment of the present invention.
Figure 4:
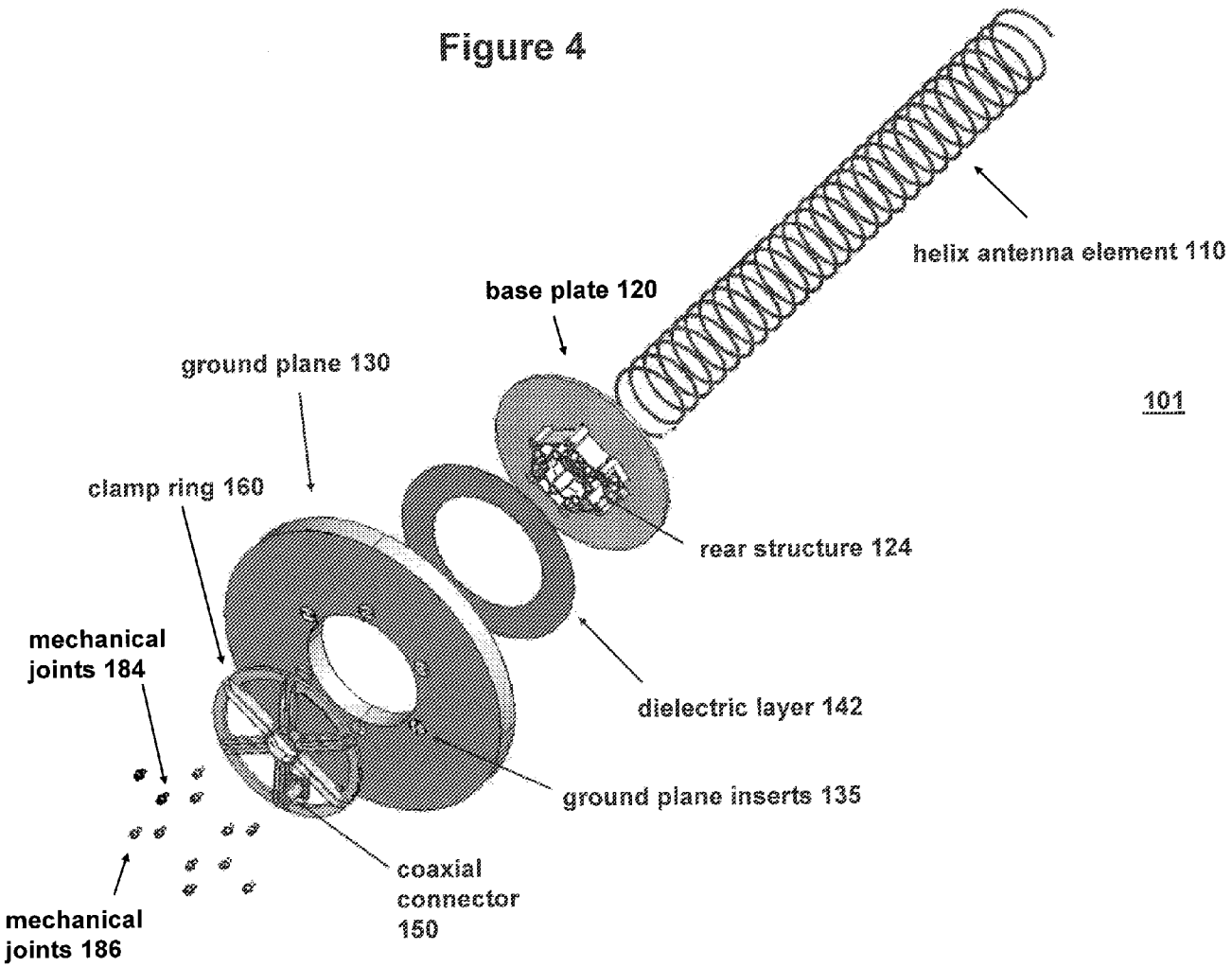
FIG. 4 is an exploded partial view of the helix antenna system seen from the back of the antenna system in accordance with one embodiment of the present invention.
Figure 5:
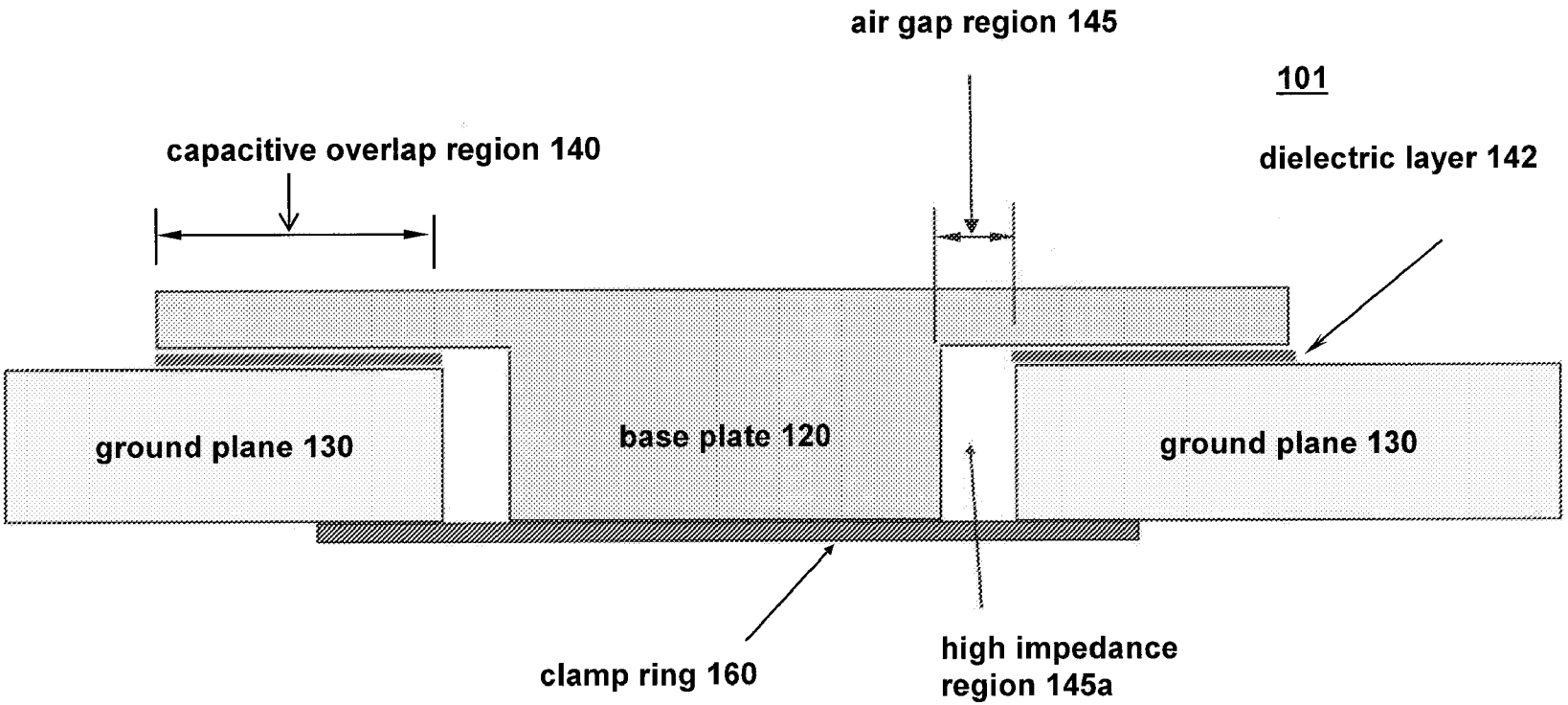
FIG. 5 is a simplified sectional view of the helix antenna system seen from a side of the antenna system in accordance with one embodiment of the present invention.

FIGS. 1-5 illustrate different views of an antenna system in accordance with one embodiment of the present invention. FIG. 1 is a simplified view of a helix antenna system seen from the front of the antenna system. FIG. 2 is a simplified view of the helix antenna system seen from the back of the antenna system. FIG. 3 is an exploded partial view of the helix antenna system seen from the front of the antenna system. FIG. 4 is an exploded partial view of the helix antenna system seen from the back of the antenna system. FIG. 5 is a simplified sectional view of the helix antenna system seen from a side of the antenna system. FIG. 6 is another simplified sectional view of the helix antenna system seen from a side of the antenna system in accordance with one embodiment of the present invention.

As illustrated in FIGS. 1-5, an antenna system 101 is a helix system according to one embodiment of the present invention. Referring to FIG. 1, the antenna system 101 includes a helix antenna element 110, a base plate 120, and a ground plane 130. The base plate 120 has front and rear surfaces that are planar and flat. The base plate 120 also includes a signal hole 126. The ground plane 130 has front and rear surfaces that are planar and flat. A capacitive overlap region 140 is formed between the base plate 120 and the ground plane 130. Referring to FIG. 2, the antenna system 101 further includes a coaxial connector 150, a clamp ring 160, and mechanical joints 184 and 186. As shown in FIG. 3, the system 101 also includes a dielectric layer 142, which is in the capacitive overlap region 140. The clamp ring 160 includes six inner holes 164 and six outer holes 162. Referring to FIG. 4, the base plate 120 includes a rear structure 124, and the ground plane 120 includes ground plane inserts 135. FIG. 5 illustrates the capacitive overlap region 140, an air gap region 145, the dielectric layer 142, and a high impedance region 145*a*, which can include a region such as the air gap region 145.

In this exemplary embodiment, the antenna element 110 is an L-band helical antenna element and is configured to radiate signals, receive signals, or radiate and receive signals. The base plate 120 may be referred to as a helix base plate, the ground plane 130 may be referred to as a ground plane panel or a ground plane honeycomb panel, and the ground plane inserts 135 may be referred to as honeycomb panel inserts. The mechanical joints 184 and 186 are metal screws in this embodiment. In alternative embodiments, mechanical joints can be other types of fasteners, clamping arrangements, bonding materials or other types of joints. Mechanical joints are not limited to these examples. Furthermore, mechanical joints can be made of conductive materials (e.g., metal) or non-conductive materials (e.g., plastic).

The components of the antenna system 101 are made of the following materials according to one embodiment of the invention. The base plate 120 is made of conductive material such as metal. The ground plane 130 is conductive. For example, the ground plane 130 can be made conductive throughout its entire body. Alternatively, only one surface of the ground plane 130 is conductive (e.g., having a graphite epoxy skin), or both surfaces of the ground plane 130—the front surface facing the antenna element 110 and the rear surface facing away from the antenna element 110 —can be made conductive. The ground plane inserts 135 are made of conductive materials such as metal. The clamp ring 160 can be conductive (e.g., aluminum) or non-conductive. The dielectric layer 142 is made of a non-conductive material (e.g., a dielectric material such as Kapton®).

Now referring to FIG. 3, the antenna element 110 can be attached to the base plate 120 by bonding, clamping, or other suitable means. A base (not shown) can also be attached to the base plate 120 using, for example, mechanical joints such as plastic screws, and the antenna element 110 may be attached to the base. According to one embodiment, the antenna element 110 is a helical element, and is wound around an epoxy-glass support structure (not shown), which is attached to the base plate 120 by bonding and by plastic screws.

Referring to FIG. 4, the ground plane inserts 135 are bonded into cavities in the ground plane 130, which in this embodiment is a honeycomb sandwich panel ground plane, using adhesive. This is a conventional technique used honeycomb sandwich panel construction. The clamp ring 160 has six outer holes 162 and six inner holes 164, as shown in FIGS. 2 and 3. The outer holes 162 are arranged along an outer diameter of the clamp ring 160, and the inner holes 164 are arranged along an inner diameter of the clamp ring 160. The mechanical joints 186 (shown in FIGS. 2-4) are placed through the outer holes 162 (shown in FIGS. 2 and 3) and the ground plane inserts 135 of FIG. 4 to attach the clamp ring 160 to the ground plane 130.

The dielectric layer 142 (shown in FIGS. 3-5) is disposed between the base plate 120 and the ground plane 130. The mechanical joints 184 (shown in FIGS. 2-4) are placed through the inner holes 164 (shown in FIGS. 2 and 3) and the rear structure 124 of the base plate 120 (shown in FIG. 4) to attach the clamp ring 160 to the base plate 120. When the clamp ring 160 is attached to the base plate 120 and the ground plane 130 as described, a capacitive overlap region 140 (providing capacitive coupling) is formed between the base plate 120 and ground plane 130 using the dielectric layer 142. The coaxial connector 150 is mounted to the base plate 120. The center conductor of the coaxial connector 150 extends through the signal hole 126 and connects to the antenna element 110. Accordingly, using the mechanical joints, the components—the antenna element 110, the base plate 120, the ground plane 130, and the clamp ring 160—are assembled and attached together to form the antenna system 101. The antenna element 110 is electrically isolated from the ground plane 130.

Referring to FIG. 5, the dielectric layer 142 is an annularly shaped film about 0.005 inches thick according to one embodiment. The capacitive overlap region 140 is a region created by an overlap of the base plate 120, dielectric layer 142 and ground plane 130. The capacitive overlap region 140 is equal to about 1 inch in width according to one embodiment. Depending on the frequency of transmission and other considerations, the overlap region may be greater or lesser. For example, for higher frequencies, the capacitive overlap region 140 may be more than one inch wide, and for lower frequencies, the capacitive overlap region 140 may be less than 1 inch wide. The width of the capacitive overlap region 140 is not limited to these numbers, and can be of other values. The thickness of the dielectric layer 142 is also not limited to 0.005 inches, and can be of other values.

The capacitance created by the base plate 120 and the ground plane 130 within the capacitive overlap region 140 is greater than the capacitance created by the base plate 120 and the ground plane 130 outside the capacitive overlap region 140. The capacitance created within the capacitive overlap region 140 is the desired capacitance. The capacitance created outside the capacitive overlap region 140 is an incidental capacitance, and it is desirable to minimize the incidental capacitance.

The capacitance created within the capacitive overlap region 140 can be greater than ten times the incidental capacitance (e.g., greater than 100 times, 1,000 times, 10,000 times or 100,000 times the incidental capacitance). Because the capacitance created within the capacitive overlap region 140 is higher than the capacitance created outside the capacitive overlap region 140, the capacitive overlap region 140 can be referred to as a low impedance region. The region outside the capacitive overlap region 140 (including a region such as the air gap region 145) can be referred to as a high impedance region (such as a high impedance region 145*a* shown in FIG. 5). The air gap region 145 is generally annular in shape and is greater than or equal to about 0.25 inches wide according to one embodiment. In an alternate embodiment, the air gap region 145 may have a different width.

Referring to FIGS. 1 and 3, each of the base plate 120 and the ground plane 130 has a front surface facing the antenna element 110. When these components are assembled together, each of these components has a front facing area (sometimes referred to an uncovered area) that is not covered up by another component and thus is exposed to the antenna system surface currents as shown in FIG. 1 or that is viewable from the front side of the antenna system 101. According to one embodiment, the base plate 120 may have an uncovered area that occupies a portion of the front surface or the entire front surface of the base plate facing the antenna element 110. The ground plane 130 may have an uncovered area that occupies a portion of the front surface or the entire front surface of the ground plane facing the antenna element 110. The phrase "front surface" or "rear surface" of a component may refer to the entire front surface or the entire rear surface of a component or may refer to a portion of the front surface or a portion of the rear surface of a component, respectively.

If mechanical joints (such as the mechanical joints 184 and 186) are made of conductive materials, the components of the antenna system 101—such as the base plate 120, the ground plane 130, and the mechanical joints 184 and 186—are configured such that none of the conductive mechanical joints protrudes into the uncovered areas of the base plate 120 and the ground plane 130. Accordingly, the uncovered areas of the base plate 120 and the ground plane 130 have no protrusions due to the conductive mechanical joints and thus have no exposed conductive mechanical joints. If, however, the mechanical joints are made of non-conductive materials, such non-conductive mechanical joints may be allowed to protrude through the uncovered areas of the base plate 120 and/or the ground plane 130. If an antenna system includes other components (e.g., a base) that are viewable from the front side of the antenna system, such components may include uncovered areas on the front surfaces that have no protrusions due to conductive mechanical joints.

As described above, the antenna system 101 shown in FIGS. 1-5 utilizes a high capacitance area (a low impedance area) in conjunction with a low capacitance area (a high impedance area) to choke off the radio frequency (RF) surface currents flowing on the rear surface of the ground plane 130. The invention can thus significantly reduce the magnitude of the RF surface currents flowing on the rear surface of the ground plane 130. The antenna system 101 also utilizes mechanical joints that are mounted from the backside of the antenna system 101, and it prevents conductive mechanical joints, which are potential passive inter-modulation (PIM) sources, from protruding into the front side of the antenna system 101.

Figure 6C:
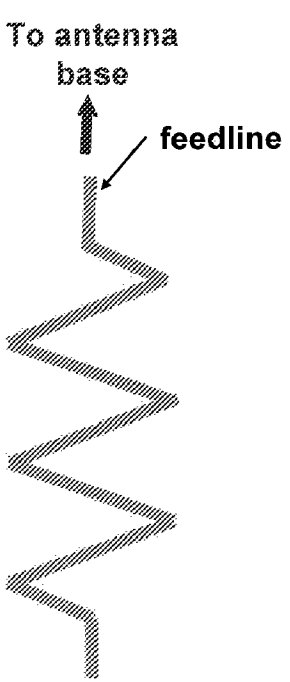
FIG. 6C illustrates a coiled feedline in accordance with one embodiment of the present invention.
Figure 6B:
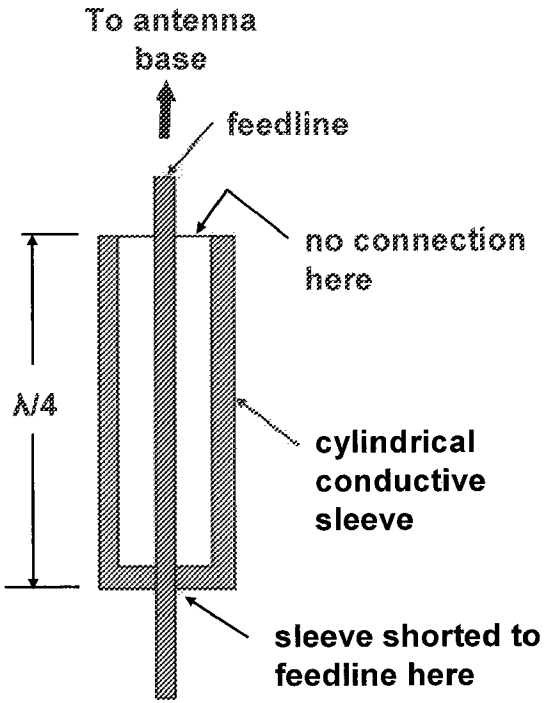
FIG. 6B illustrates a coaxial sleeve choke in accordance with one embodiment of the present invention.
Figure 6A:
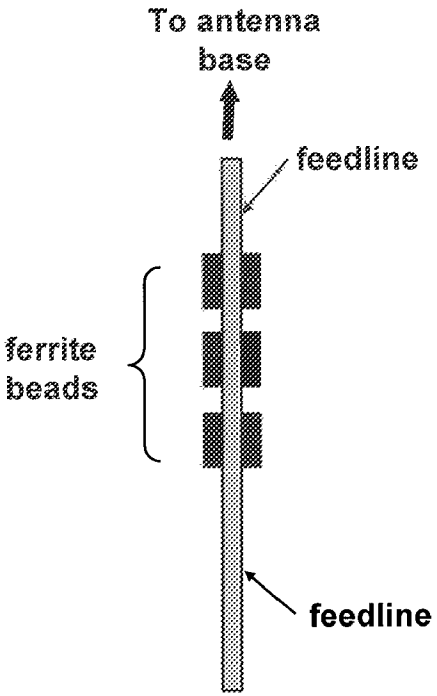
FIG. 6A illustrates a ferrite bead choke in accordance with one embodiment of the present invention.

Depending upon the specific geometries involved and the frequency range, attenuation of RF surface currents may be required on coaxial cables, waveguides, or similar conductive paths that attach to the rearward structure of the antenna system 101. Control of these currents can be accomplished in a number of ways, for example, by use of choke devices such as bal-un structures, by forming the transmission lines into coils thus creating an inductive choke, or by use of ferrites. Exemplary methods of suppressing RF currents on a feedline are shown in FIGS. 6A, 6B and 6C. A feedline can be, for example, a coaxial cable, a waveguide, or any other suitable transmission line.

FIG. 6A illustrates a ferrite bead choke, wherein a feed line is surrounded by ferrite beads. FIG. 6B illustrates a coaxial sleeve choke, wherein a feedline is surrounded by a cylindrical conductive sleeve. FIG. 6C illustrates a coiled feedline.

Figure 7:
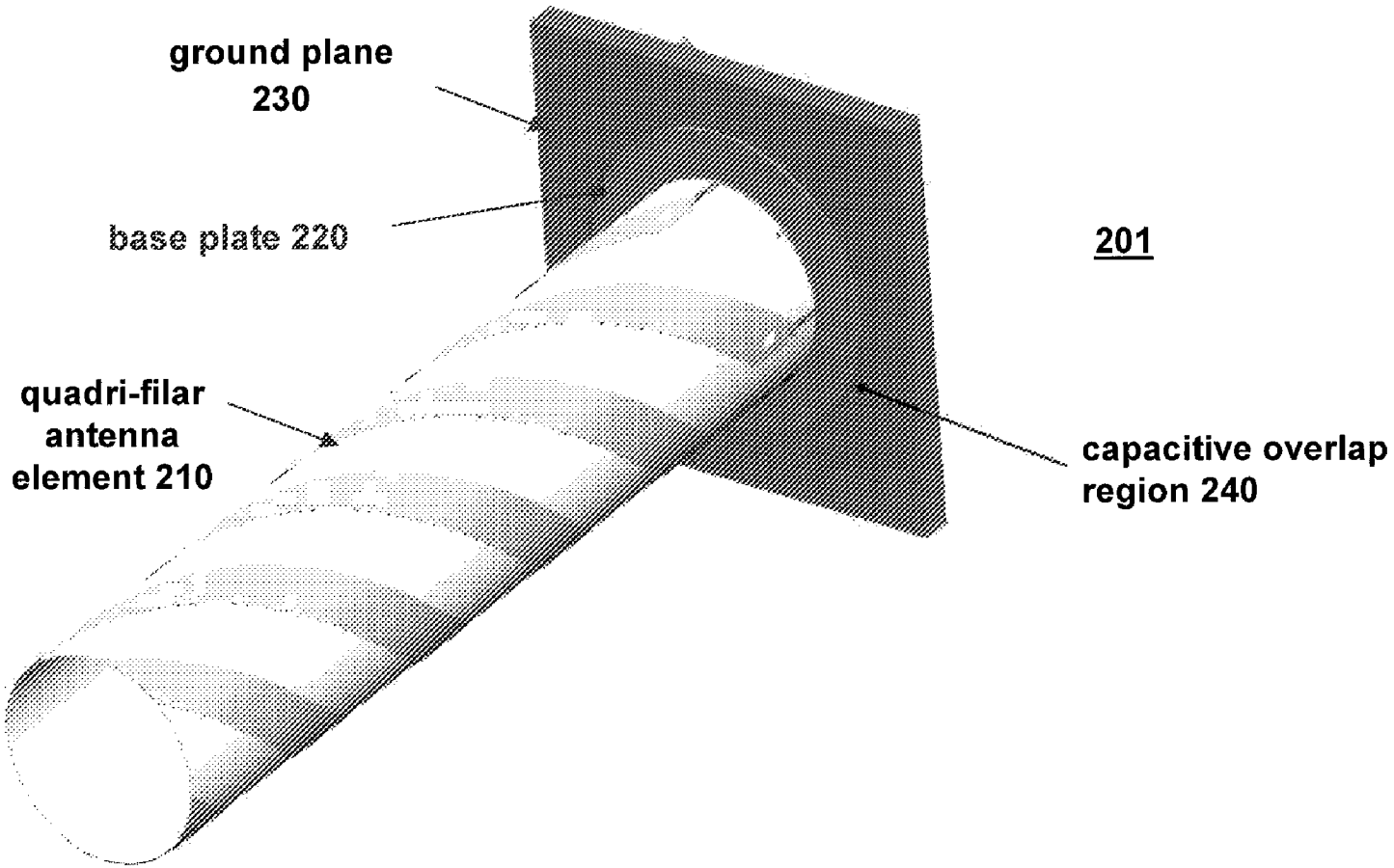
FIG. 7 is a simplified view of a quadri-filar antenna system seen from the front of the antenna system in accordance with one embodiment of the present invention.
Figure 8:
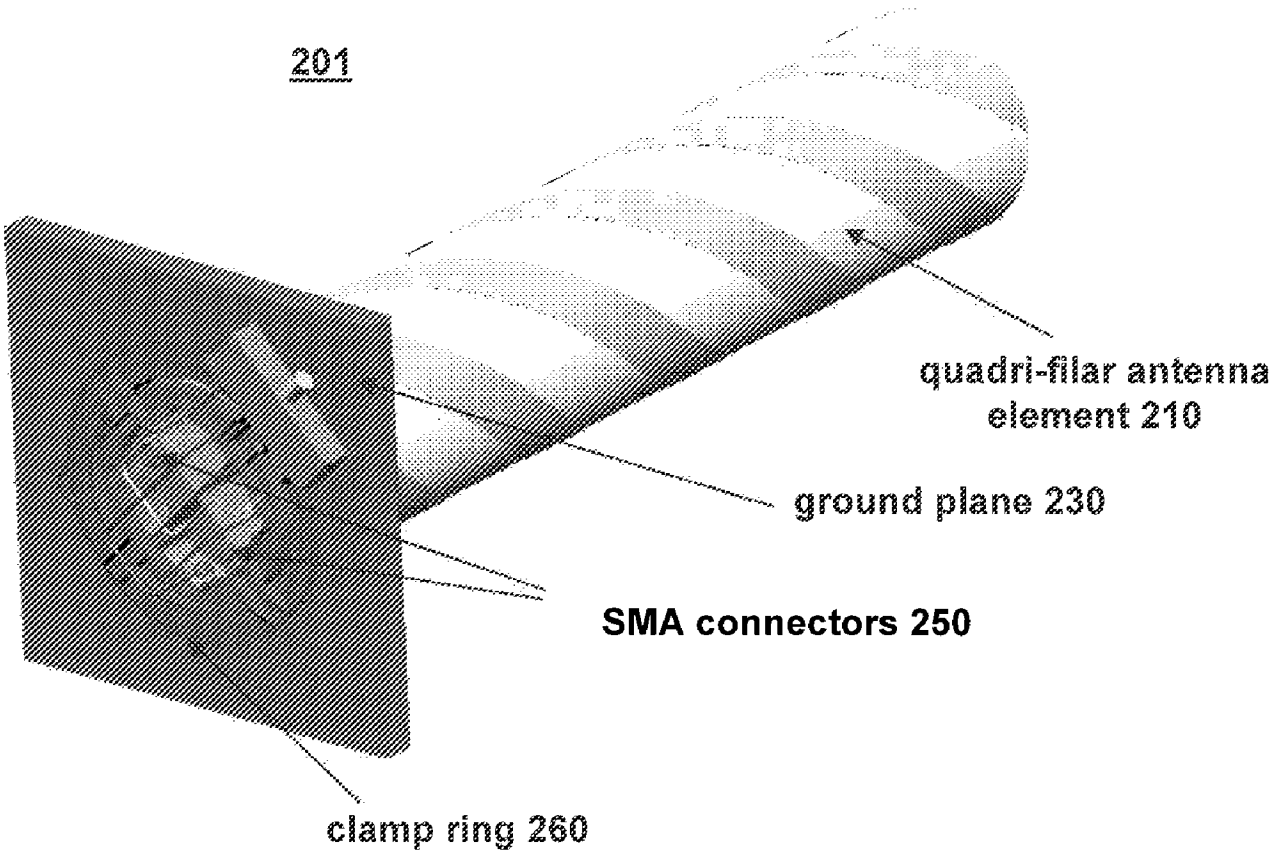
FIG. 8 is a simplified view of the quadri-filar antenna system seen from the back of the antenna system in accordance with one embodiment of the present invention.
Figure 9:
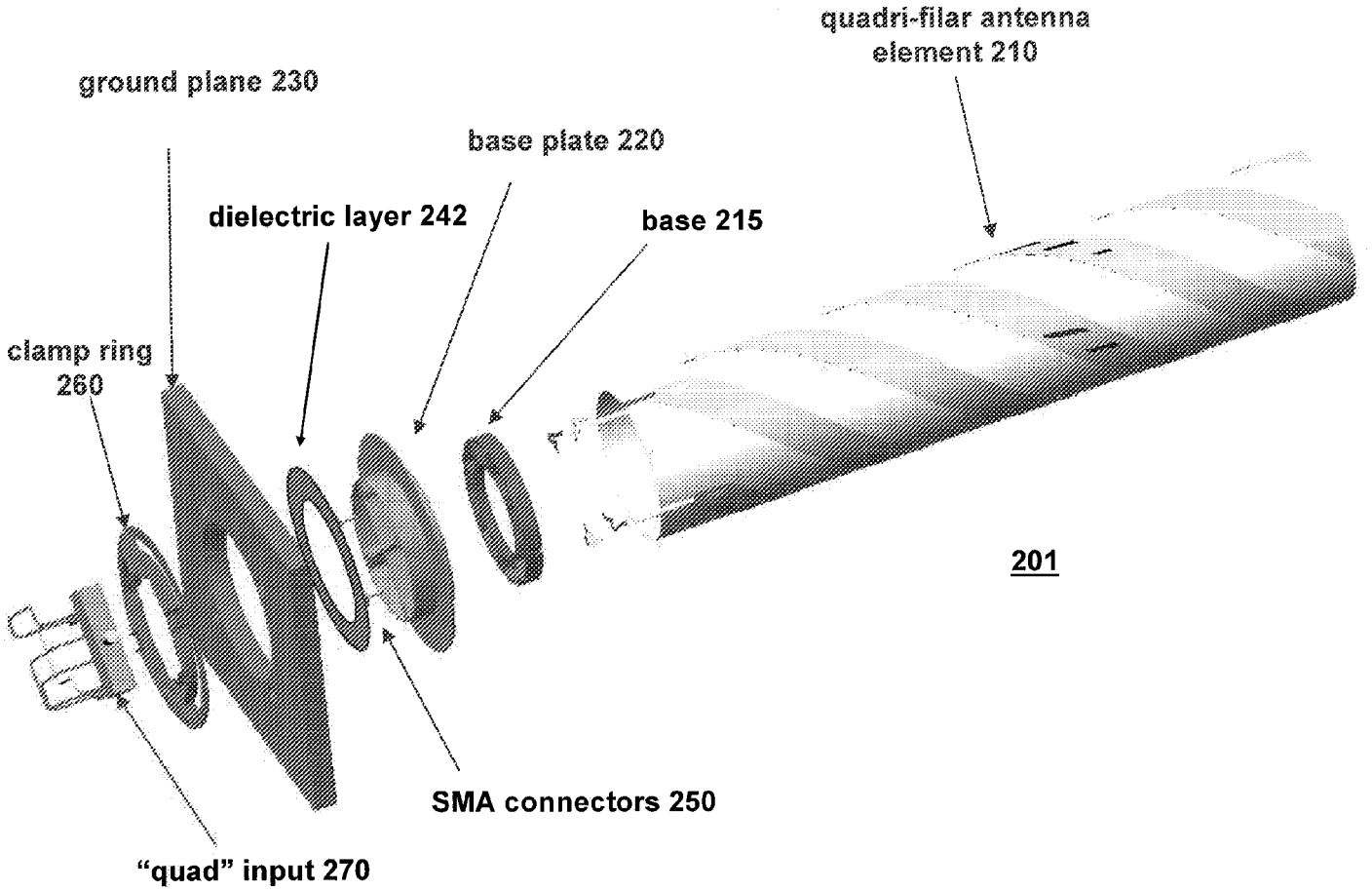
FIG. 9 is an exploded partial view of the quadri-filar antenna system seen from the back of the antenna system in accordance with one embodiment of the present invention.
Figure 10:
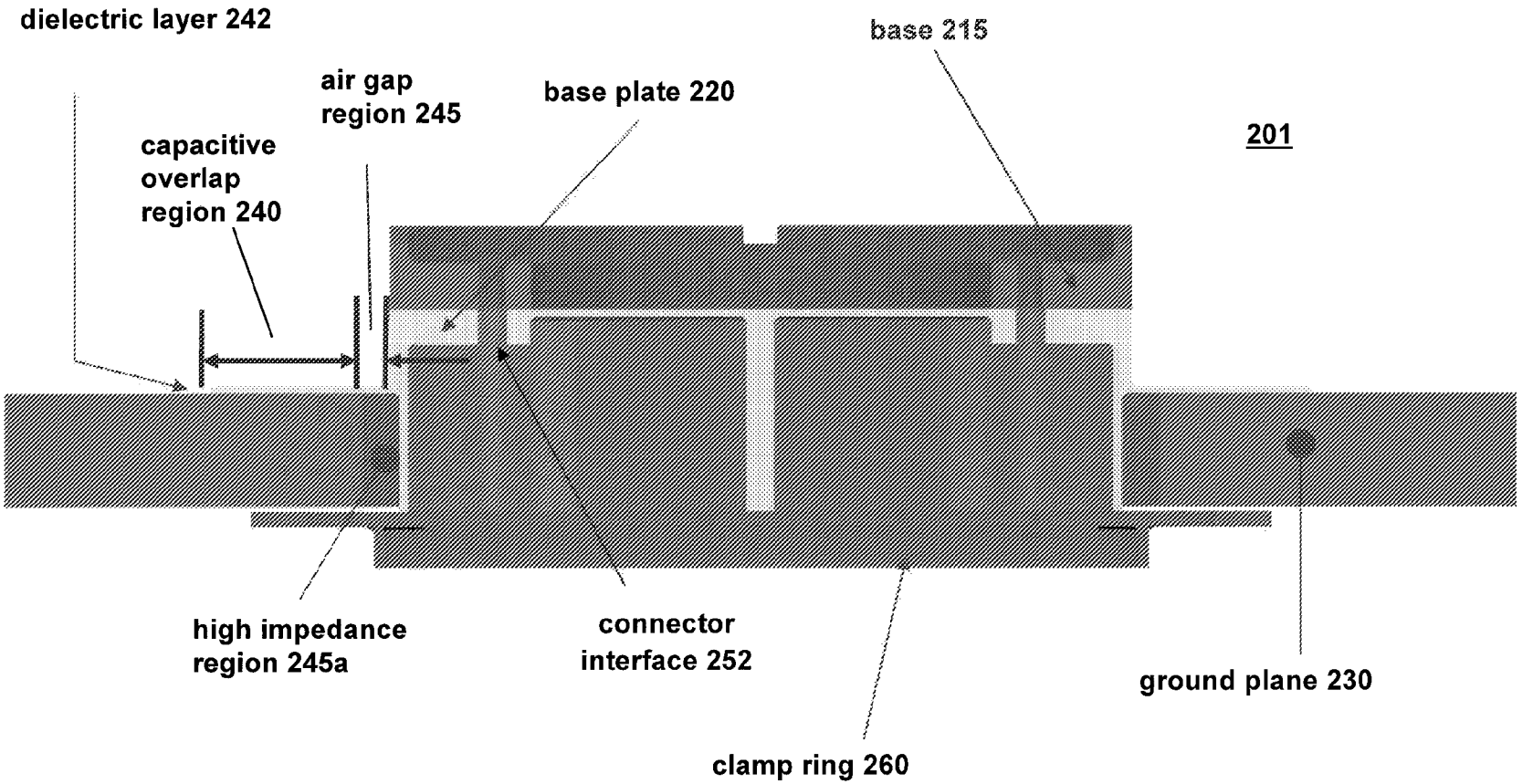
FIG. 10 is a simplified sectional view of the quadri-filar antenna system seen from a side of the antenna system in accordance with one embodiment of the present invention.

FIGS. 7-10 illustrate a set of views of an antenna system in accordance with one embodiment of the present invention. FIG. 7 is a simplified view of a quadri-filar antenna system seen from the front of the antenna system. FIG. 8 is a simplified view of the quadri-filar antenna system seen from the back of the antenna system. FIG. 9 is an exploded partial view of the quadri-filar antenna system seen from the back of the antenna system. FIG. 10 is a simplified sectional view of the quadri-filar antenna system seen from a side of the antenna system.

As illustrated in FIGS. 7-10, an antenna system 201 is a quadri-filar antenna system according to one embodiment. Referring to FIG. 7, the antenna system 201 includes a quadri-filar antenna element 210, a base plate 220, and a ground plane 230. Referring to FIG. 8, the antenna system 201 further includes SMA connectors 250 and a clamp ring 260. As shown in FIG. 9, the system 210 also includes a base 215, a dielectric layer 242, and a "quad" input 270. FIG. 10 illustrates a capacitive overlap region 240, an air gap region 245, the dielectric layer 242, a high impedance region 245*a*, and a connector interface 252.

In this exemplary embodiment, the antenna element 210 is a UHF element, and is configured to radiate signals, receive signals, or radiate and receive signals. The base 215 may be a UHF base plug. Referring to FIG. 10, the dielectric layer 242 is an annularly shaped film about 0.005 to 0.01 inches thick according to one embodiment. The capacitive overlap region 240 is a region created by an overlap of the dielectric layer 242, the base plate 220 and the ground plane 230. The capacitive overlap region 240 is greater than or equal to about 1 inch in width. The air gap region 245 is generally annular in shape and is greater than or equal to about 0.25 inches wide according to one embodiment. The descriptions provided above with respect to FIGS. 1-5 apply similarly to the antenna system 201 of FIGS. 7-10.

The description of the present invention is provided to enable any person skilled in the art to practice the various embodiments described herein. While the present invention has been particularly described with reference to the various figures and embodiments, it should be understood that these are for illustration purposes only and should not be taken as limiting the scope of the present invention.

There may be many other ways to implement the present invention. For example, an array of antenna systems can be employed. In addition, the invention is not limited to a helix antenna element or a quadri-filar antenna element, and it can be applied to other types of antenna elements such as a monopole antenna element, a sleeve monopole antenna element, a patch antenna element, a slot antenna element, a spiral antenna element, a dipole antenna element, or a plurality of any of the aforementioned antenna elements (e.g., an array of helix antenna elements, an array of quadri-filar antenna elements, an array of monopole antenna elements, an array of spiral antenna elements, or an array of multiple types of antenna elements).

Various components described herein may be partitioned differently from those shown without departing from the spirit and scope of the present invention. For example, if a first component is integrated into a second component, then the integrated portion of the second component can be viewed as the same as or equivalent to the first component. Various modifications to these embodiments will be readily apparent to those skilled in the art, and generic principles defined herein may be applied to other embodiments. Thus, many changes and modifications may be made to the present invention, by one having ordinary skill in the art, without departing from the spirit and scope of the present invention.

A reference to an element in the singular is not intended to mean "one and only one" unless specifically stated, but rather "one or more." The term "some" refers to one or more. All structural and functional equivalents to the elements of the various embodiments described throughout this disclosure that are known or later come to be known to those of ordinary skill in the art are expressly incorporated herein by reference and intended to be encompassed by the invention. Moreover, nothing disclosed herein is intended to be dedicated to the public regardless of whether such disclosure is explicitly recited in the above description.

What is claimed is:

1. An antenna system comprising:

an antenna element configured to radiate signals, receive signals, or radiate and receive signals;

a base plate having a front surface facing the antenna element and a rear surface facing away from the antenna element, the front surface of the base plate having an uncovered area, the uncovered area of the base plate having no exposed conductive mechanical joints, wherein the uncovered area of the base plate is planar having no protrusions;

a ground plane having a front surface facing the antenna element and a rear surface facing away from the antenna element, the front surface of the ground plane having an uncovered area, wherein the uncovered area of the ground plane is planar having no protrusions; and a capacitive coupling between the base plate and the ground plane formed by an overlap region between the base plate and ground plane, the ground plane capacitively coupled to the base plate in the overlap region.

2. A system of claim 1, wherein the uncovered area of the ground plane has no exposed conductive mechanical joints.

3. A system of claim 1, wherein a capacitance created by the base plate and the ground plane within the overlap region is greater than a capacitance created by the base plate and the ground plane outside the overlap region.

4. A system of claim 1, wherein the capacitive coupling comprises a layer of dielectric material disposed between the base plate and ground plane in the overlap region.

5. A system of claim 1 further comprising mechanical joints formed by fasteners, clamping arrangements, bonding or a combination thereof.

6. A system of claim 1 further comprising non-conductive mechanical joints.

7. A system of claim 6, wherein at least some of the non-conductive mechanical joints are viewable from a front side of the antenna system.

8. A system of claim 1 further comprising conductive mechanical joints.

9. A system of claim 1 further comprising a base, a clamp ring and mechanical joints, wherein some of the mechanical joints are used to attach the clamp ring and the ground plane together, some of the mechanical joints are used to attach the base plate and the clamp ring together, and some of the mechanical joints are used to attach the base and the base plate together.

10. A system of claim 1, wherein the capacitance created by the base plate and the ground plane within the overlap region is greater than 100 times the capacitance created by the base plate and the ground plane outside the overlap region.

11. A system of claim 1, wherein the base plate, the ground plane and the capacitive coupling are configured to reduce a radio frequency (RF) surface current level at the rear surface of the ground plane.

12. A system of claim 1 further comprising mechanical joints, wherein the base plate, the ground plane, the capacitive coupling, and the mechanical joints are configured to reduce passive inter-modulation.

13. A system of claim 1, wherein the antenna element is a helix antenna element, a quadri-filar antenna element, a monopole antenna element, a sleeve monopole antenna element, a patch antenna element, a slot antenna element, a spiral antenna element, a dipole antenna element, or a plurality of any of the aforementioned antenna elements.

14. A system of claim 1 further comprising: ground plane inserts, a clamp ring, mechanical joints, and a coaxial connector.

15. An antenna system comprising:

an antenna element configured to radiate signals, receive signals, or radiate and receive signals;

a base plate having a front surface facing the antenna element and a rear surface facing away from the antenna element, the front surface of the base plate having an uncovered area, wherein the uncovered area of the base plate is planar having no protrusions;

a ground plane having a front surface facing the antenna element and a rear surface facing away from the antenna element, the front surface of the ground plane having an uncovered area, wherein the uncovered area of the ground plane is planar having no protrusions;

a capacitive coupling between the base plate and the ground plane formed by an overlap region between the base plate and ground plane, the ground plane capacitively coupled to the base plate in the overlap region, a capacitance created by the base plate and the ground plane within the overlap region being greater than a capacitance created by the base plate and the ground plane outside the overlap region; and mechanical joints mounted from a rear side of the antenna system, the mechanical joints not viewable from a front side of the antenna system.

16. A system of claim 15, wherein the capacitive coupling comprises a layer of dielectric material disposed between the base plate and ground plane in the overlap region.

17. A system of claim 15 further comprising mechanical joints formed by fasteners, clamping arrangements, bonding or a combination thereof.

18. A system of claim 15 further comprising non-conductive mechanical joints.

19. A system of claim 18, wherein at least some of the non-conductive mechanical joints are viewable from a front side of the antenna system.

20. A system of claim 15, wherein the mechanical joints are conductive.

21. A system of claim 15 further comprising a base and a clamp ring, wherein some of the mechanical joints are used to attach the clamp ring and the ground plane together, some of the mechanical joints are used to attach the base plate and the clamp ring together, and some of the mechanical joints are used to attach the base and the base plate together.

22. A system of claim 15, wherein the base plate, the ground plane, the capacitive coupling, and the mechanical joints are configured to reduce passive inter-modulation.

* * * * *